US005215717A

United States Patent [19]

Conant et al.

[11] Patent Number: 5,215,717

[45] Date of Patent: Jun. 1, 1993

[54] PLASTIC LABORATORY BOILER

[75] Inventors: Louis A. Conant; Wilbur M. Bolton, both of Rochester; James E. Wilson, Livonia, all of N.Y.

[73] Assignee: Intertec Associates, Inc., Rochester, N.Y.

[21] Appl. No.: 719,251

[22] Filed: Jun. 27, 1991

Related U.S. Application Data

[63] Continuation-in-part of Ser. No. 548,629, Jul. 5, 1990, abandoned.

[51] Int. Cl.[5] ..... B01L 3/00

[52] U.S. Cl. ..... 422/102; 422/103; 422/104; 215/307; 215/276; 220/356; 220/361

[58] Field of Search ..... 422/102, 103, 104, 130, 422/240, 241; 126/390; 215/307, 308, 309, 276; 220/356, 361

[56] References Cited

U.S. PATENT DOCUMENTS 4,944,923 7/1990 Heinrichs et al. ..... 422/104

OTHER PUBLICATIONS

Fisher Scientific Catalog, 1986, p. 736.

*Primary Examiner*—Lynn M. Kummert

*Attorney, Agent, or Firm*—Cumpston & Shaw

[57] ABSTRACT

A boiler having an improved plastic closure having a plastic and/or plastic-glass joint for connecting laboratory ware made of a material having different thermal expansion. The plastic joint includes a tubular plastic section having a compression ring secured at its end which recesses the labware of lower thermal expansion. The plastic-glass joint further includes a shorter standard tapered glass joint.

12 Claims, 2 Drawing Sheets

PLASTIC LABORATORY BOILER

This is a continuation-in-part application of U.S. application Ser. No. 07/548,629, filed Jul. 5, 1990, now abandoned.

FIELD OF THE INVENTION

This invention relates to a heatable vessel with a closure that interconnects to conventional glassware systems, useful generally in laboratory, industrial or service applications wherein glass boilers and boiling vessels would generally be used. The plastic closure with its unique joints can also be used with other types of heatable vessels.

BACKGROUND OF THE INVENTION

Glass boilers, boiling vessels, and the like are used in virtually all chemical laboratories because of their excellent chemical resistance and transparency. Stainless steel vessels are also used, but are limited because of their poor resistance to some acids and other chemicals. Glass boilers are generally interconnected to condensers, columns, receivers, and other glassware. Connections are made through standard joints known as interchangeable taper-ground joints, or standard taper joints (S.T.). Spherical joints are used to a lesser extent or can be connected to standard taper joints by means of adapters. Glass boiling vessels are generally the most vulnerable component of the boiler system, being sensitive to scratches, nicks, and other defects which act as stress raisers resulting in catastrophic failure at the slightest impact. Glass vessels generally boil liquids in a non-uniform manner, frequently with superheating and bumping.

A variety of plastic materials, particularly the fluoroplastics, are also highly resistant to most chemicals, even more so than borosilicate glass. Some are transparent or translucent, and resistant to breakage. However, plastic materials have low thermal conductivity, about ¼ to 1/6 that of glass and, therefore, are poorly suited for making boilers or boiling flasks. However, fluoroplastic (polytetrafluoroethylene) boilers and boiling flasks are available with rounded bottoms suitable for use with heating mantles. Some of the boilers have molded on PTFE joints for connections to PTFE receivers and other PTFE laboratory ware. Such vessels heat very slowly because of the low thermal conductivity of the plastic. These PTFE vessels are opaque.

It is, therefore, apparent that there has existed for a long time a need for an efficient transparent or translucent plastic boiler that brings liquids to a rapid, uniform and smooth boil, free of bumping. One that connects to virtually any glass system, is chemically resistant, a kilowatt saver, and adds a big safety factor—being shatter and impact resistant.

SUMMARY OF THE INVENTION

The present invention adds a truly new boiler system to laboratory ware providing a composite plastic boiler that can be directly heated on a hot plate and that easily interconnects to conventional glassware systems. A boiler where liquids contact only chemically and biologically resistant surfaces. A boiler that brings liquids to a rapid, uniform and smooth boil, free of superheating and bumping. One that adds a big safety factor, being shatter and impact resistant, that is a time and kilowatt saver. Normally glass and plastic, with their widely divergent thermal expansions cannot be effectively interconnected with all-plastic, or all-glass joints for use at elevated temperatures. However, the closure with its unique composite joints of the plastic boiler system of this invention make this interconnection very functional. Thus, glass boiling vessels can be replaced by the more effective and safe composite plastic boiler system significantly increasing the efficiency and performance of glass systems for evaporations distillations, refluxing, extractions, purifications, recovery, and other processes.

The composite plastic boiler comprises:

a plastic vessel having a heatable bottom;

a closure secured to the top of the vessel having at least one composite plastic and/or plastic/glass joint secured to said closure providing a passageway through said closure for connection with the interior of said vessel for connection to a piece of labware being made of a material having a thermal expansion less than said joint, said joint comprising a generally tubular plastic section and a compression ring of a lower thermal expansion material attached to its upper end.

A closure system that can be used with plastic coated or lined stainless steel vessels, and to upgrade the safety, and also, usefulness with glass vessels as reaction kettles and beakers. The closure system includes a closure designed to substantially seal a vessel and unique composite joints.

DETAILED DESCRIPTION OF THE INVENTION

Figure 1:
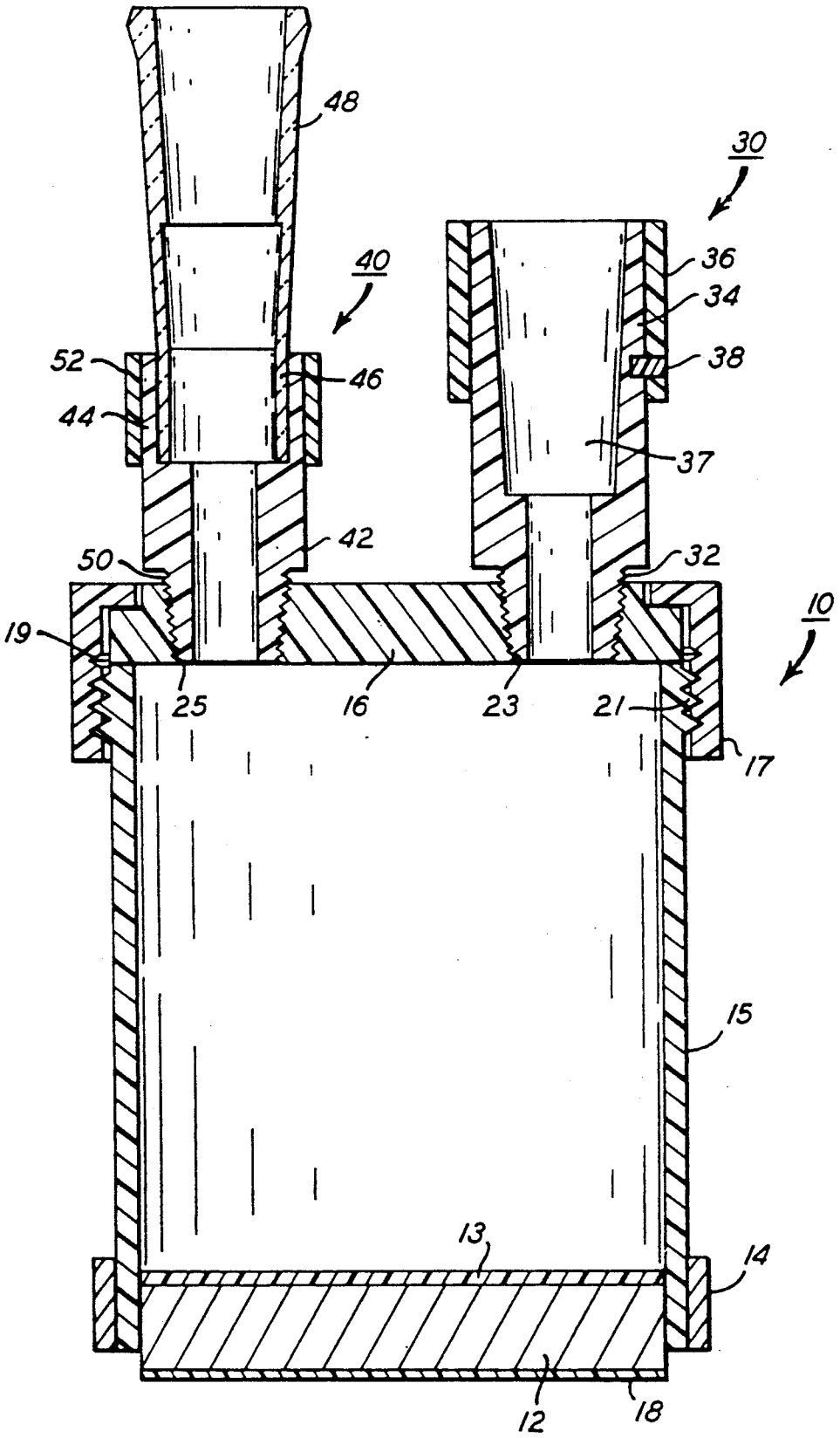
FIG. 1 is a cross-sectional view of a composite plastic laboratory boiler with a closure having two types of composite plastic joints made in accordance with the present invention.

Referring to FIG. 1, there is illustrated a composite plastic laboratory boiler system made in accordance with one embodiment of the present invention. The boiler comprises a vessel 10 having a plastic sidewall with a graphitic or metallic heatable bottom 12 having a chemically resistant and non-contaminating coating or laminate 13 on its inner surface and a chemically resistant coating 18 on its outer surface, said coatings having sufficient thickness so as to provide minimal resistance to heat transfer but of sufficient thickness to resist liquid penetration into the heatable bottom. A metallic corrosion resistant compression ring 14 is heat shrunk around the bottom 12 annular sidewall 15 of the vessel 10 and firmly seals and secures the heatable bottom 12 to plastic sidewall 15. A Mason jar-type closure assembly is provided so as to seal vessel 10 which comprises a peripheral plastic threaded annular ring 17 and disc 16. The ring 17 having internal threads 19 that engage external threads 21 disposed on the upper end of sidewall 15 and effectively seals top disc 16 to sidewall 15 of vessel 10. Disc 16 is provided with threaded ports 23, 25 for connecting threaded stem end 32 of composite tubular plastic joint 30 and threaded stem end 42 of composite tubular plastic-glass joint 40 to disc 16 of vessel 10.

Joint 30 comprises a tubular plastic section 34 with an internal passage 37 of standard taper geometry. Joint 30 connects to standard taper glassware (not shown). Joint 30 includes a loose fitting metal or reinforced plastic peripheral compression ring 36 which constrains the upper end of tubular plastic section 34 from expanding away from the inserted inner standard taper glass joint (not shown) when heated, because of the lower thermal expansion of said metal or reinforced plastic ring 36, the tubular plastic section 34 is strongly compressed around the inserted inner joint of the glassware by the constraining action of the peripheral metal or reinforced plastic ring 36, preventing it (the glass joint) from sinking too low in the tapered passageway 37, which would otherwise be expanding much more than the glass joint at elevated temperatures without the ring 36. This would result in dimensional changes, distortions of the plastic, a poorly sealed joint, and strong sticking action between the parts. The metal, or reinforced plastic pin 38, keeps the ring 36 from slipping down tubular plastic section 34 at room temperature where it would have a loose fit.

The joint 40, based on the same principle of the compression ring 36 as joint 30, allows the chemist to have a glass to glass connection, which some chemists may prefer, and as in joint 30, has a plastic to plastic connection to disc 16. In joint 40, the tubular plastic section 42 has an upper end 44 into which is secured the stem end 46 of a standard taper outer glass joint 48, for connecting to standard taper glassware, and a cover stem end 50, externally threaded for fastening to the threaded port 25 of disc 16. The shortened lower stem end 46 of the outer glass joint 48 is tightly sealed to the upper end 44 of tubular plastic section 42 with a metal, or reinforced plastic compression ring 52 that effectively eliminates the problem of the widely divergent thermal expansions between glass and plastic, allowing for the interconnection of glassware and the plastic boiler.

The boiler system of the present invention provides a number of favorable characteristics and properties not found in prior art laboratory boiler system to the best of our knowledge. A boiler according to the present invention has a good thermally conductive bottom that allows direct heating on a hot plate, and closure assembly with top ports that connect to composite plastic joints for direct interconnection to virtually any glassware system. The vessel brings liquids to a rapid, uniform and smooth boil, free of bumping at lower hot plate temperatures. This is a time and kilowatt saver for many types of evaporations, distillations, extractions and other processes. The vessel is preferably made of a translucent fluoroplastic (PFA) with a PTFE closure and joints, or other chemically resistant plastics, and has a graphitic or metallic heatable bottom with a chemically resistant, non-contaminating coating on its inner side, and a chemically resistant coating on its outer side. The boiler system offers greater safety, being shatter, thermal shock and impact resistant. This is particularly important when used under vacuum, as the boiler vessel is usually the most vulnerable part of a glassware system. The plastic boiler system increases the efficiency and performance of glass systems for evaporations, distillations, refluxing, extractions, purifications, recovery, and others. For example, comparative water heating and evaporation tests with borosilicate glass vessels, of a comparative size, showed a 1½ to 2 superiority of the composite plastic boiler vessels in boiling and evaporation rates over the glass boiling vessels.

The boiler vessel itself is made by injection molding a thermoplastic, fluoroplastic resin such as PFA, FEP, or others. (It should be noted that although PTFE is classified as a thermoplastic, it is much too viscous for commercial type injection molding.) A bottom heatable insert disc can be included during injection molding. Another commercial method starts with a plain plastic injection molded vessel, having top external threads. In this case, the bottom is machined out and a coated or laminated heatable bottom disc inserted, and sealed by shrink filling a metallic compression ring. A Mason jar-type top closure assembly is used, having an internally threaded ring that seals the flat top cover. The top cover has threaded ports for connection to the composite plastic joints, thermometer holder, feed funnel, a magnetic stirrer assembly, consisting of a teflon encapsulated magnet on PTFE shaft suspended from cover, or other accessories. Other methods of connecting joints and accessories to the top cover can be used, such as clamping, taper fits, and others. Other type closures can be used including internally fitting with fluoroplastic o-rings or gaskets, or insert types with over-the-rim flanges, flanged covers to fit vessels designed with flanges, and insert-flanged types to fit beaker type vessels. Other type vessels can also be used, including heatable flanged plastic vessels and plastic beakers.

While the bottom heatable plastic vessels are preferred, other type vessels would also be useful, including plastic, glass, or ceramic, coated or lined metallic vessels, fitted with the plastic closure of the invention.

Glass vessels would also be more useful, particularly the flanged or straight walled reactor kettle, and the glass beaker, with or without a spout. The kettle is used with a relatively expensive glass closure having a ground flange and 1–6 molded necks (ground S.T. joints). This closure made of thick glass is a safety hazard, being highly sensitive to impact and thermal shock, and vulnerable to catastrophic failure. It is also an economic liability since a broken or chipped neck would render it useless. A plastic closure and joints made in accordance with the present invention would not only be much safer, but would outlast many of the expensive glass covers.

The composite joints 30, 40 of the invention are unique in that they provide a means for interconnecting the boiler vessel to virtually any glassware system. Either all-plastic or glass joints would not not be suitable because of the very wide difference in thermal expansions between plastics and glass. Thus, the linear coefficient of expansion for polytetrafluoroethylene (PTFE) is $12.1\times10^{-5}$/in/in/°F. between 77°–572° F., whereas standard laboratory borosilicate glass has a linear coefficient of expansion of $1.8\times10^{-6}$/in/in/°F. (between 32°–572° F.). A PTFE outer joint would therefore expand sixty-seven times more than a matching glass inner joint at elevated temperatures. It is, therefore, clear that an inner S.T. joint on a glass condenser or other glass joint inserted into a PTFE outer S.T. joint on the boiler closure, and supported in the vertical refluxing position, would fit poorly, and leak badly under vacuum. If the condenser was not well supported, as frequently is the case, so that all or part of its weight rested on the plastic joint, the inner glass joint would tend to sink into the expanded outer plastic joint, at elevated temperatures, causing a gradual elongation of the joint depending on the load (stress), temperature, and time. Upon cooling, the inner glass joint would be strongly wedged into the plastic joint, and would require heating to remove.

If a composite joint 30, having a metal or reinforced plastic compression ring was used, in FIG. 1, the tubular plastic section 34 would be constrained by the ring 36, and expand very little. In this case the glass inner joint of the condenser would be held tightly by the plastic, under the constraint of the compression ring 36. The fit would therefore be good, and little or no sticking would occur. In the case of the composite plastic glass joint 40 of FIG. 1 the inner S.T. glass outer joint of the condenser would form a perfect thermal expansion match with the glass end of the composite S.T. outer joint and the plastic (PTFE) stem end of the joint would have the same thermal expansion as the plastic (PTFE) top of the boiler closure to which it would fasten. The tubular plastic of the composite S.T. joints is preferably made of a fluoroplastic, particularly polytetrafluoroethylene (PTFE) or perfluoroalkoxy (PFA) because of their relatively high use temperatures, 500°-550° F., and especially their excellent resistance to chemicals, being as good or even better than glass. However, for many applications the polyolefins such as polyethylene and polypropylene are suitable, or other appropriate, chemically resistant, anti-contaminating plastics.

For the composite S.T. joint 40 shown in FIG. 1, the upper S.T. outer glass joint is made of a chemically resistant standard laboratory grade borosilicate glass. The stem end of S.T. glass joint is shortened by cutting off about 2 inches.

The metal or reinforced plastic compression rings 52 and 36 are made of an aluminum alloy such as 6061 with a good combination of mechanical properties and corrosion resistance. The stainless steels particularly the 300 series are also excellent alloys for the compression rings 52 and 36. Most metals and alloys with good corrosion resistance can be used for the compression rings 52 and 36, or rings with a chemically resistant coating. Reinforced plastics are used in applications where an all plastic boiler without a heatable bottom is heated by microwaves, since metals would not be acceptable. Materials such as continuous filament woven glass fabric grades impregnated with epoxy resin such as Nema G-10 type GEE, or Glass-Epoxy Nema G-11, Type GFB or other comparable materials.

Figure 2:
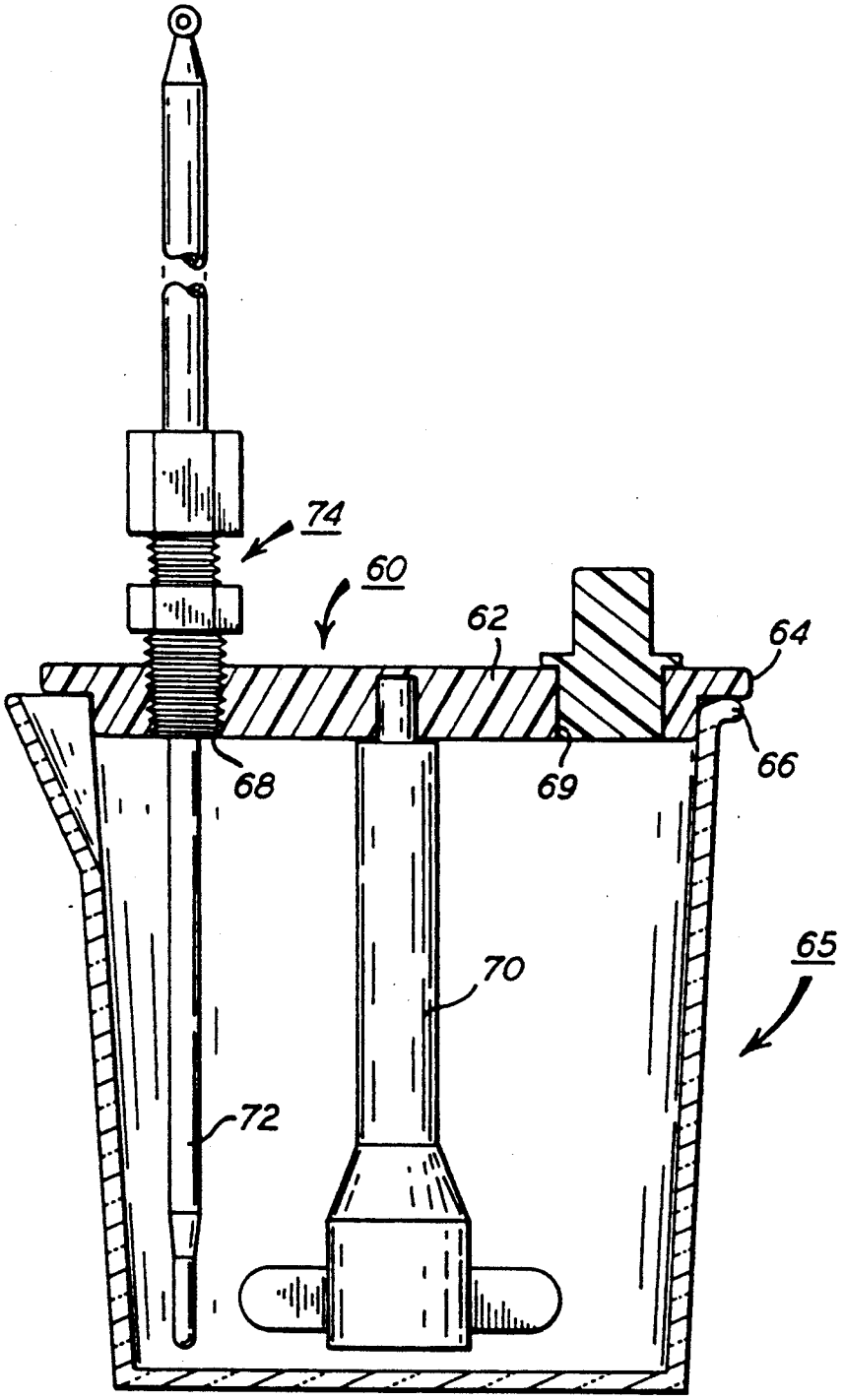
FIG. 2 is a cross-sectional view of a closure system made in accordance with a modified form of the present invention.

The glass beaker is perhaps the most widely used vessel in the laboratory that could be upgraded to a much safer and versatile vessel with the plastic closure system of the present invention. Referring to FIG. 2, there is illustrated a plastic closure system 60 made in accordance with the present invention. The closure system 60 includes an insert-type plastic closure 62 having an annular flange 64 that fits over the rim 66 of a vessel 65. In the embodiment illustrated, vessel 65 is a glass beaker. The closure 62 has ports 68,69 for receiving joints and accessories. In the particular embodiment illustrated, a shafted magnetic stirrer 70 is suspended from the inner side of the closure 62 which would convert the vessel 65 into a reactor vessel, safer for digestions, dissolutions, evaporations, mixing, and many others. A joint 30 or 40 may be secured to closure 62 through port 69 in the same manner as joint 40 is secured to disc 16 of FIG. 1. In the particular embodiment illustrated, a thermometer 72 is secured to closure 62 through the use of a standard joint 74. The closure 62 is shatter, thermal shock and impact resistant and closes much more secure than the now used shifty top-of-the-rim watch glass type covers when working with corrosives, toxic materials, and vapors. It would be ideal for schools with limited budgets, where the beaker-closure vessel could be used for many experiments to where relatively more expensive boiling flasks are now required. This would provide greater safety, and at the same time, significantly lower the breakage costs. In many cases, low cost polypropylene could be used in place of teflon plastics for the closure.

Applicants built and tested the plastic boiler and closure systems of this invention. The description and results of such efforts are set forth in the following examples.

EXAMPLE 1

The plastic boiler system was built in accordance with the illustration of FIG. 1, and fabricated by machining out the bottom of an injection molded perfluoroalkoxy (PFA) plastic one liter screw cap jar. The screw cap closure was also machined to leave only a Mason jar-type ring to secure and seal a disc of polytetrafluoroethylene (PTFE). The disc 16 was machined from a ½ inch thick sheet of PTFE plastic, as the top of the closure assembly of the vessel. Threaded ports 23, 25 were also machined into the top of the closure to accommodate the stem threaded composite joints and other accessories such as a sparging rod, a thermometer holder, plugs and others. The heatable bottom disc 12 was machined from an extruded graphite cylinder having a bulk density of 1.7 g/cc and a fine to medium grain size structure. The disc was laminated with a PFA film layer of about 0.010 inch thick, at a molding temperature of about 600° F., and a pressure of 200-300 psi for a time of 5 minutes. The PFA polymer was forced into the pores of the graphite surface forming a strong bond, and being reduced to a 0.007-0.008 inch thick film coating. This film layer formed the inner surface 13, of the vessel illustrated in FIG. 1. The outer side of bottom disc was coated with a high temperature epoxy resin about 0.002 inch thick shown as 18 of FIG. 1. The disc 12 was then positioned in the vessel bottom and secured by a shrunk fit aluminum compression ring 14 of FIG. 1.

The plastic boiler was evaluated by several testing methods, the first to compare boiling and evaporation rates with those of a standard borosilicate glass flat bottom vessel of the same capacity, in this case a one liter beaker. Normally glass boiling vessels have a round bottom. This would have required a heating mantle whereas the plastic boiler would have been heated on a hot plate, making a one to one comparison difficult. Both vessels containing 450 ml of distilled water were heated on a hot plate at a starting temperature of 560° F., without a closure. The water in the plastic boiler came to a brisk, uniform boil in 13.5 min. with complete evaporation in 78.0 min. The water in the glass vessel came to a slow irregular boil in 21.0 min. with evaporation in 118.0 min. or a boil ratio of 21/13.5=1.6 advantage of the plastic boiler, and an evaporation ratio 118/78=1.5 advantage over glass. At a hot plate temperature of 700° F. (371° C.) the borosilicate boiling vessel took about twice as long to come to a slow irregular boil, with an evaporation rate about one third that of the plastic boiler. At a hot plate temperature of 1000° F. (538° C.) the plastic boiler showed a 2/1 superiority over the glass vessel in boiling rate, and a 1.85 margin over the glass vessel in evaporation rate.

EXAMPLE 2

An empty plastic boiler vessel, as described in Example 1, was subjected to a long time heating test on a hot plate at 550° F. The continuous test lasted 168 hours after which the hot vessel was quickly removed from the hot plate and plunged into cold water. The boiler was then filled with water (600 ml) placed on a hot plate at 700° F. and brought to a brisk boil. No damage to the vessel occurred. The quench test in cold water illustrated the excellent thermal shock resistance of the vessel.

It should be noted that the plastic boiler vessel should not be allowed to heat to dryness at a hot plate temperature over plastic is about 590°-600° F. Liquids with boiling points about 550° F., such as concentrated sulfuric acid, should not be boiled in the vessel. However, most liquids can be heated to the limit of the hot plate. Glass vessels have a much higher softening and melting point, however, glass vessels are vulnerable to cracking if heated to dryness.

EXAMPLE 3

A plastic boiler vessel described in Example 1 was subjected to the following impact tests. A boiler with the closure removed was filled with 800 ml of water, the total weight being 2.96 lbs. The filled vessel was taken outdoors and dropped on a concrete walk from a measured height of 5 ft. This was repeated 3 times and the vessel examined for damage. This amounted to edge chipping of the graphite disc 12 and denting of the aluminum compression ring 14. The sustained impact was 14.8 ft./lbs. The vessel was then filled with water and heated on a hot plate at 700° F. to a brisk boil. The boiler proved to be free of leaks. This severe test demonstrated the impact safety of plastic boiler vessel.

EXAMPLE 4

The composite plastic joint 30 of FIG. 1 was fabricated by machining a PTFE 1.25 in. diameter rod into a tubular form with its upper end of standard taper (S.T.) geometry 37. An aluminum alloy 6061 tube was machined to give a compression ring 36 of FIG. 1, 1.0 in. wide with an I.D. of 0.0625 in. and a wall thickness of 0.060 in. An aluminum rivet was used as a fastening pin 38, and was inserted into a blind hole in the tubular plastic section 34. The stem end of composite plastic S.T. joint was connected to a threaded port 23 or 25 of disc 16 and the upper S.T. end to a 24/40 inner end of a S.T. glass joint, with the outer 24/40 S.T. end of the adapter connected to the inner joint side of a Friedrich-type refluxing condenser. The adapter was used in the event of a tightly sticking joint that would be difficult to remove if connected directly to the inner condenser joint. When it was determined that no sticking occurred, the condenser was connected directly to the composite joint. Testing consisted of the continuous refluxing of boiling water, or solvent, with intermittent cool-downs for measurement checks and examination of the composite joint. The condenser was vertically positioned by a clamp and support stand. Although, about half the weight of the water filled condenser (load) was supported by the composite joint. The objective was to determine the extent of creep (deformation) that slowly occurs under a continuous load. Creep increases with stress (load) temperature, and time. This was observed with plain PTFE S.T. joints without metal or reinforced compression rings as will be described in this and other examples. A plain PTFE 24/40 S.T. joint was connected to a condenser as described above. The first check, after 5 hours of refluxing, showed the joint too tight for removal from the glass adapter joint without unscrewing the stem end of the plastic joint from the boiler closure. Removal eased with each additional check. After 28 hours of refluxing, the upper Inside Diameter of the PTFE joint had expanded 6.4 percent from the original measurement. After 94.5 hours, testing was terminated when examination and measurement of the joint indicated that the Inside Diameter of the upper end of the joint increased 0.012±0.002 inches. This allowed the bottom end of the inner glass adapter joint to touch the bottom of the PTFE joint at the stem section. Thus, the joint no longer formed a seal with the glass adapter joint. A composite S.T. joint with an aluminum compression ring, was tested under the same conditions as the plain PTFE joint above, for 226 hours with intermittent cool-downs. An overall elongation of about 0.009 in. occurred, but no appreciable change in the Inside Diameter (0.002 in.) was observed. Seal integrity was good and the glass adapter joint released easily from the composite joint.

EXAMPLE 5

A new design plain PTFE S.T. joint with an extended taper section was tested for 125.5 hours. The Friedrich refluxing condenser was connected directly to the joint for half the time, and to a glass adapter joint, connected to the condenser, for the balance of the time. After 20 hours and upon cool-down, the joint showed an elongation of 0.085 in. and a diameter decrease of 0.007 in. At the end of the test period of 125.5 hours, the glass S.T. joint of the adapter was tightly wedged in the PTFE outer joint, and had to be removed still attached to the adapter joint, and heated in an oven to separate the two. A second composite S.T. joint with a reinforced plastic compression ring (G11, type GEB. Glass-Epoxy) was tested under the conditions as the plain PTFE joint above for 148 hours, half the time connected directly to the condenser and to the condenser via the glass adapter for the balance of the time. Dimensional changes were minimal with a decrease in the Inside Diameter of 0.002 in. and an elongation of 0.006 in. Both the glass adapter and condenser joint were easily removed without sticking.

EXAMPLE 6

A composite tubular PTFE plastic-glass standard taper (S.T.) joint of the type 40 shown in FIG. 1 was fabricated as follows. The tubular plastic section 42 was machined from a cylindrical rod (1.25 in. diameter) and the metal compression ring 52 was machined from type 316 stainless steel tubing. The ring 52 was then shrunk fit over the tubular plastic, tightly sealing the tubular plastic section 44 to the shortened stem 46 of the glass joint, and effectively constraining the tubular plastic section from expanding away from the stem of the glass joint. The stem end of the tubular plastic section 50 was previously threaded by machining to fasten to the threaded port 25 of the PTFE disc 16. The joint was tested as described in Example 4 with the inner joint of the Friedrich condenser connected directly to the outer S.T. glass end of the composite joint 40 illustrated in FIG. 1. After 250 hours of refluxing boiling water with intermittent cool-downs, no dimensional changes were noted, and no sticking occurred since the glass to glass connection was a perfect match of thermal expansions. Although glass to glass joints may stick depending on chemicals used and experimental set-up, this can be easily controlled by the use of a thin (0.0015-0.003 in.) PTFE sleeve that fits around the inner tapered glass joint.

EXAMPLE 7

A composite S.T. joint 30 illustrated in FIG. 1 was fabricated as described in Example 4 with an aluminum compression ring 36. The composite joint was tested as described in Example 4 for 75 hours by refluxing with boiling tetrachloroethylene ($C_2C_{14}$-B.P. 250° F.) with intermittent cool-downs. The composite joint was connected directly to the glass inner joint of the Friedrich-type condenser. No significant dimensional changes were noted and no sticking occurred.

EXAMPLE 8

A plastic boiler was built in accordance with the illustration in FIG. 1 and as described in Example 1, with the exception that an aluminum bottom disc 12 was substituted for the graphite bottom disc 12. The aluminum disc 12 was machined from an aluminum alloy 6061, and laminated with a 0.010 in. PFA plastic film layer on the inner side of the disc 12. The boiler was set-up for simple distillation of water, under a vacuum, at a pressure of 120 mbar. (Normal atmospheric pressure is about 1013 mbar.) The hot plate temperature was 340° C. (644° F.), water vapor temperature was 55° C. (131° F.), the condensation rate was 950 ml/hr. This compares favorably with similar size (1 liter) rotary-type evaporators at 860 ml/hr., Rotary evaporators generally have evaporation rates 2 to 3 times higher than conventional laboratory glass boiler set-ups.

EXAMPLE 9

A 600 ml PFA plastic beaker was fitted with a heatable bottom as described in Example 1, except for the vessel type. The closure was machined from ½ in. thick PTFE plastic sheet, as an insert type with a small outer flange that just covered the rim. The diameter of the inserted section of the cover was about the same as the inner diameter of the vessel, and extended 5/16 in. below the rim, the flanged section was about 3/16 in. thick and extended about 1/16 in. beyond the rim, leaving the spout uncovered. Ports were machined into the cover disc to accommodate composite plastic joints, a thermometer holder, a feed funnel, plugs or other accessories, the number of ports being dependent on the size (diameter) of the vessel.

The vessel was tested as in Example 1, and showed about the same ratio of superiority in boiling and evaporation as in Example 1.

EXAMPLE 10

A 400 ml Griffin low form glass beaker was fitted with a polypropylene plastic closure, instead of teflon, as described in Example 9, except that an appropriate expansion clearance was allowed for the differences in expansion coefficients between glass and the plastic. The closure was also fitted with a magnetic stirrer assembly consisting of a teflon encapsulated magnet on a PTFE shaft suspended from the underside of the cover. The magnet was just above the beaker bottom. A thermometer holder secured in a threaded port , supported a glass thermometer just above the bottom of the vessel, with no interference from magnetic stirrer. A threaded port with a plug was provided to fit a 14/20 S.T. composite plastic joint 30.

This plastic closure offers greater safety, and is more secure than a shifty top-of-the-rim watch glass type cover, when working with corrosives and toxic materials. Cover is easily held in place while pouring through spout, minimizing inhalation of toxic vapors, or spillage. If securing the cover more securely is desired, a semi-circumferential plastic or metal snap-on clamp can be used.

EXAMPLE 11

A 1000 ml glass reactor kettle with a grounds flange rim was fitted with a flat teflon PTFE plastic cover disc ½ in. thick. The underside of the cover was machined ⅛ in. from its edge, with an o-ring type band to form a seal when clamped to the flange of a typical glass kettle (reactor kettle). This would allow for the higher expansion of the cover compared to the glass. Ports were machined into the cover to accommodate a 24/40 S.T. center positioned composite plastic joint 30, three of the 24/40 S.T. composite plastic joints 30 disposed on the side, and a thermometer holder.

Testing both the glass cover with molded joints (necks) and the invention closure on the same vessel by stirring a viscous mix and distilling off contained water, gave about the same performance. The advantages of the plastic closure are significant; namely, greater safety and economy. The thick glass closure is a safety hazard, being highly sensitive to impact and thermal shock, and vulnerable to catastrophic failure. It is also an economic liability since a broken or cracked neck would render it useless. The plastic closure and its joints would not only be much safer but would outlast many of the expensive glass covers.

EXAMPLE 12

A 316 stainless steel vessel with a welded on flanged rim was coated internally with a PFA fluoroplastic powder resin to as thickness of 0.004–0.005 in. The vessel of 1000 ml capacity was of the same dimensions as the glass vessel of Example 11 so that the same plastic closure could be used.

The vessel was tested in the same manner, although heating was much faster. The closure worked well, comparable to the other vessel tests.

The coated vessel is, of course, more rugged and could be easily scaled up to pilot plant or commercial scale operations. This also would be true with the plastic closure.

It is to be understood that various changes and modifications may be made without departing from the scope of the present invention. The present invention being limited by the following claims.

What is claimed is:

1. In a plastic laboratory boiling vessel suitable for interconnection to laboratory glassware, the improvement comprising, a plastic top closure for said vessel, with at least one composite plastic outer joint attached through a section of said closure, said at least one joint providing an interconnecting passageway for fluids from an interior of said vessel through said closure to a piece of laboratory glassware, said at least one joint comprising a generally tubular plastic section of outer standard taper geometry having a lower end and an upper end, and a constraining compression ring made of a material having a lower thermal expansion than said at least one plastic joint, attached to and circumferentially surrounding the upper end of said plastic section, said ring having a loose fit at room temperature, with the lower end of said at least one plastic joint being attached through the section of the top closure of said vessel.

2. A vessel according to claim 1 wherein said plastic vessel, closure and tubular plastic section are made of a fluoroplastic, polyolefin, or other chemically resistant non-contaminating plastics.

3. A vessel according to claim 2 wherein said vessel, closure and at least one joint are preferably made of a fluoroplastic including perfluoroalkoxy (PFA), polytetrafluoroethylene (PTFE), or fluorinated ethylene propylene (FEP) plastics.

4. The vessel according to claim 1 wherein the vessel is made of glass and the closure is made of plastic.

5. A vessel according to claim 1 wherein said compression ring is made of aluminum metal or alloys, stainless steels, or other corrosion resistant metals or alloys.

6. A vessel according to claim 1 wherein said compression ring of said at least one joint is made of a reinforced plastic material of a lower thermal expansion than said plastic section of said at least one joint.

7. In a plastic laboratory boiling vessel suitable for interconnection to laboratory glassware, the improvement comprising, a plastic top closure for said vessel, with at least one composite plastic glass joint attached through a section of said closure, said at least one joint providing an interconnecting passageway for fluids from an interior of said vessel through said closure to a piece of laboratory glassware, said at least one joint comprising a generally tubular plastic section having a lower end and an upper end with the upper end attached to and surrounding a lower stem end of an outer standard taper glass joint by means of a compression ring made of a material having a lower thermal expansion than said plastic section, said ring tightly sealing said upper end of said plastic section to the lower stem end of said outer standard taper glass joint, for interconnection to the inner joints of standard taper laboratory glassware, with the lower end of said at least one plastic joint being attached through the section of the top closure of said vessel.

8. A vessel according to claim 7 wherein said plastic vessel, closure and tubular plastic section are made of a fluoroplastic, polyolefin, or other chemically resistant noncontaminating plastics.

9. A vessel according to claim 7 wherein said vessel, closure and at least one joint are prefereably made of a fluoroplastic including perfluoroalkoxy (PFA), a polytetrafluoroethylene (PTFE), or fluorinated ethylene propylene (FEP) plastics.

10. A vessel according to claim 7 wherein the vessel is made of glass and the closure is made of plastic.

11. A vessel according to claim 7 wherein said compression ring is made of aluminum metal or alloys, stainless steels, or other corrosion resistant metals or alloys.

12. A vessel according to claim 7 wherein said compression ring of said at least one joint is made of a reinforced plastic material of a lower thermal expansion than said tubular plastic section of said at least one joint.

* * * * *